US009051140B2

(12) United States Patent
Ichikawa

(10) Patent No.: US 9,051,140 B2
(45) Date of Patent: Jun. 9, 2015

(54) SHEET CONVEYING DEVICE AND IMAGE FORMING APPARATUS PROVIDED WITH THE SAME

(71) Applicant: Brother Kogyo Kabushiki Kaisha, Nagoya (JP)

(72) Inventor: Hiroshi Ichikawa, Okazaki (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/317,178

(22) Filed: Jun. 27, 2014

(65) Prior Publication Data

US 2015/0008637 A1 Jan. 8, 2015

(30) Foreign Application Priority Data

Jul. 8, 2013 (JP) ..... 2013-142729

(51) Int. Cl.
*B65H 5/02* (2006.01)
*B65H 5/04* (2006.01)
*B65H 5/06* (2006.01)

(52) U.S. Cl.
CPC ..... *B65H 5/062* (2013.01); *B65H 5/068* (2013.01)

(58) Field of Classification Search
CPC ..... B65H 5/06; B65H 5/062; B65H 2404/14; B65H 2404/143; B65H 2404/144; B65H 5/068
See application file for complete search history.

(56) References Cited

U.S. PATENT DOCUMENTS

| | | | | |
|---|---|---|---|---|
| 5,762,332 | A * | 6/1998 | Haroutel et al. | 271/274 |
| 5,964,462 | A * | 10/1999 | Saltsov | 271/274 |
| 2003/0047862 | A1* | 3/2003 | Komatsu | 271/10.01 |
| 2004/0262837 | A1 | 12/2004 | Hamada et al. | |
| 2007/0045945 | A1* | 3/2007 | Iwago | 271/272 |

FOREIGN PATENT DOCUMENTS

| | | | |
|---|---|---|---|
| JP | 02-243437 | | 9/1990 |
| JP | 06-255830 | | 9/1994 |
| JP | 08-091635 | | 4/1996 |
| JP | 2000-095393 | A | 4/2000 |
| JP | 2002-356242 | A | 12/2002 |
| JP | 2003-165648 | A | 6/2003 |
| JP | 2005-001827 | A | 1/2005 |
| JP | 2006-124081 | A | 5/2006 |
| JP | 2010-247929 | A | 11/2010 |
| JP | 2011-026056 | A | 2/2011 |

* cited by examiner

*Primary Examiner* — Prasad Gokhale
(74) *Attorney, Agent, or Firm* — Burr & Brown, PLLC

(57) ABSTRACT

A sheet conveying device includes: first, second and third rollers, a conveying member, a frame, a first pressing member, and a force-generating unit. The first and second rollers rotate while nipping the sheet therebetween. The third roller and the conveying member nip the sheet therebetween. The frame is elongated parallel to an axis about which the third roller rotates and supports the third roller. The first pressing member applies a first pressing force to an axial center of the first roller to press the first roller toward the second roller and applies a reaction force of the first pressing force to the frame to press the frame in a direction toward the conveying member. The force-generating unit generates a nipping force for nipping the sheet between the third roller and the conveying member and applies an urging force to the frame in a direction away from the conveying member.

15 Claims, 6 Drawing Sheets

SHEET CONVEYING DEVICE AND IMAGE FORMING APPARATUS PROVIDED WITH THE SAME

CROSS REFERENCE TO RELATED APPLICATION

This application claims priority from Japanese Patent Application No. 2013-142729 filed Jul. 8, 2013. The entire content of the priority application is incorporated herein by reference.

TECHNICAL FIELD

The present invention relates to a sheet conveying device that conveys sheets, and to an image forming apparatus provided with this sheet conveying device.

BACKGROUND

Normally, a roller used to convey sheets is supported at both ends of its rotational axis. When a load acts on the roller, the roller bows in its axial center region. Consequently, compressive force applied by such rollers to a sheet and forces such as pressure between the contacting surfaces of the sheet and rollers and pressure between the contacting surfaces of the rollers (hereinafter collectively referred to as "the nipping force") are smaller in the axial center region of the rollers.

Since slippage is more likely to occur between the sheet and rollers when the nipping force is smaller, a reduced nipping force in the axial center region of the rollers may lead to sheet-conveying problems. To address this issue, the invention disclosed in Japanese unexamined patent application publication No. HEI-8-91635, for example, attempts to avoid a reduced nipping force in the center region of a pair of rollers disposed in confrontation with each other by applying pressure to the axial center region of at least one roller in a direction toward the other roller.

SUMMARY

This sheet conveying device is provided with a pressing member, such as a spring. One end of the pressing member exerts a force on one of the rollers, pressing the roller toward the other roller. Consequently, a force generated as a reaction to the pressing force (hereinafter referred to as "the reaction force") must be absorbed and is normally absorbed by a reinforcing member, such as a frame.

However, there is a possibility that the frame incurring the reaction force will deform and bow over time. If the frame deforms in this manner, the rollers may not be able to produce the required nipping force in their axial center region, even with the pressure applied by the spring or the like.

In view of the foregoing, it is an object of the present invention to provide a sheet conveying device that prevents a reduction in a nipping force between a pair of rollers by restraining deformation of a frame used to absorb a reaction force to a force acting to press the pair of rollers.

In order to attain the above and other objects, the present invention provides a sheet conveying device configured to convey a sheet along a sheet-conveying path. The sheet conveying device may include: a first roller; a second roller; a third roller; a conveying member; a frame; a first pressing member; and a force-generating unit. The first roller may be configured to rotate while contacting the sheet. The first roller may rotate about a rotational axis extending in an axial direction and have an axial center region in the axial direction. The second roller may be disposed in confrontation with the first roller. The second roller may be configured to rotate while nipping the sheet in cooperation with the first roller. The third roller may be disposed spaced apart from the first roller. The third roller may rotate about a rotational axis extending in the axial direction and be configured to rotate while contacting the sheet. The conveying member may be disposed in confrontation with the third roller. The conveying member may be configured to nip the sheet in cooperation with the third roller. The frame may be elongated in the axial direction and support the third roller. The first pressing member may be configured to apply a first pressing force to the axial center region of the first roller to press the first roller toward the second roller. The first pressing member may be further configured to apply, to the frame, a reaction force generated as a reaction to the first pressing force to press the frame in a direction toward the conveying member. The force-generating unit may be configured to generate a nipping force for nipping the sheet between the third roller and the conveying member. The force-generating unit may be further configured to apply an urging force to the frame in a direction away from the conveying member.

According to another aspect, the present invention provides an image forming apparatus that may include: a sheet conveying device configured to convey a sheet along a sheet-conveying path; and an image forming unit configured to form an image on the sheet conveyed by the sheet conveying device. The sheet conveying device may include: a first roller; a second roller; a third roller; a conveying member; a frame; a first pressing member; and a force-generating unit. The first roller may be configured to rotate while contacting the sheet. The first roller may rotate about a rotational axis extending in an axial direction and having an axial center region in the axial direction. The second roller may be disposed in confrontation with the first roller. The second roller may be configured to rotate while nipping the sheet in cooperation with the first roller. The third roller may be disposed spaced apart from the first roller. The third roller may rotate about a rotational axis extending in the axial direction and be configured to rotate while contacting the sheet. The conveying member may be disposed in confrontation with the third roller. The conveying member may be configured to nip the sheet in cooperation with the third roller. The frame may be elongated in the axial direction and support the third roller. The first pressing member may be configured to apply a first pressing force to the axial center region of the first roller to press the first roller toward the second roller. The first pressing member may be further configured to apply, to the frame, a reaction force generated as a reaction to the first pressing force to press the frame in a direction toward the conveying member. The force-generating unit may be configured to generate a nipping force for nipping the sheet between the third roller and the conveying member. The force-generating unit may be further configured to apply an urging force to the frame in a direction away from the conveying member.

DETAILED DESCRIPTION

Figure 1:
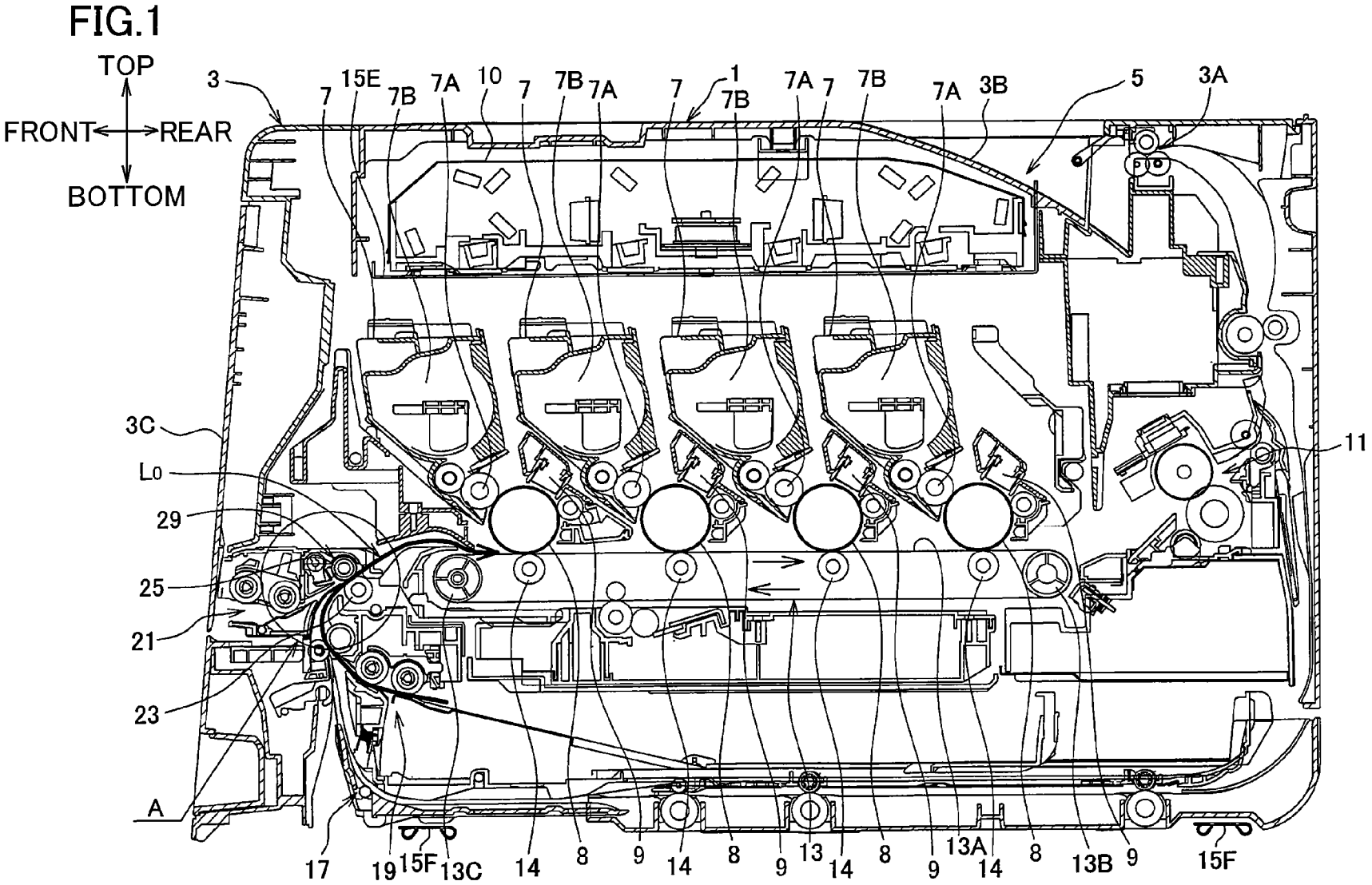
FIG. 1 is a center cross-sectional view of an image forming apparatus provided with a sheet conveying device according to one embodiment of the present invention.

1. Overall Structure of Image Forming Apparatus

An image forming apparatus provided with a sheet feeding device as a sheet conveying device according to one embodiment of the present invention will be described with reference to FIG. 1. A detailed structure of the sheet feeding device will be described later with reference to FIG. 2 through 6, wherein like parts and components are designated by the same reference numerals to avoid duplicating description.

Arrows indicating directions and the like in the drawings are intended to facilitate understanding of how the drawings relate to each other, and the present invention is not limited to these specified directions. The present invention is provided with at least one of those parts and components designated with symbols or reference numerals, except when the parts and components are specifically specified as being "a plurality of," "two or more," or the like.

In the following description, the terms "upward", "downward", "upper", "lower", "above", "below", "beneath", "right", "left", "front", "rear" and the like will be used assuming that the image forming apparatus 1 is disposed in an orientation in which it is intended to be used. More specifically, in FIG. 1, a left side and a right side are a front side and a rear side, respectively. Further, in FIG. 1, a top side and a bottom side are a top side and a bottom side, respectively. Further, in FIG. 1, a near side and far side are a right side and a left side, respectively.

As illustrated in FIG. 1, the image forming apparatus 1 includes a casing 3, and an electrophotographic image forming unit 5 accommodated in the casing 3.

The image forming unit 5 is adapted to form images on sheets of paper or another recording medium. The image forming unit 5 includes a plurality of (four in the embodiment) developer cartridges 7, a plurality of (four in the embodiment) photosensitive drums 8, a plurality of (four in the embodiment) chargers 9, an exposure unit 10, a fixing unit 11 and an endless belt 13.

The four developer cartridges 7 are juxtaposed in a juxtaposed direction (front-rear direction in the embodiment) inside the image forming unit 5. Each of the developer cartridges 7 includes a developing roller 7A, and a storage section 7B. The storage section 7B serves to store developer therein. From one side (front side in the embodiment) to another side (rear side in the embodiment) of the juxtaposed direction, the storage sections 7B of the developer cartridges 7 accommodate developer in the color order yellow, magenta, cyan, and black.

Four each of the photosensitive drums 8 and the chargers 9 are provided to correspond to the four developer cartridges 7. The photosensitive drums 8 are adapted to carry developer images on their circumferential surfaces. The chargers 9 are adapted to apply electrical charges to the corresponding photosensitive drums 8. Once charged, the photosensitive drums 8 are exposed by the exposure unit 9, forming an electrostatic latent image on each photosensitive drum 8. The developing rollers 7A supply developer stored in the corresponding storage sections 7B to the corresponding photosensitive drums 8. Through this operation, developer images corresponding to the electrostatic latent images are carried on the circumferential surfaces of the photosensitive drums 8.

The endless belt 13 is looped around and supported on a drive roller 13B and a follow roller 13C. When the endless belt 13 rotates, a top surface 13A of the endless belt 13 that opposes the photosensitive drums 8 moves from the one side (front side in the embodiment) to the other side (rear side in the embodiment) in the juxtaposed direction.

The endless belt 13, the drive roller 13B, and the follow roller 13C constitute a belt unit that is detachably mounted in an apparatus body. Here, "apparatus body" denotes portions of the image forming apparatus 1 that a user cannot detach or replace, such as the casing 3 and a pair of main frames 15A (described later) illustrated in FIG. 2.

As illustrated in FIG. 1, a plurality of (four in the embodiment) transfer bodies 14 is provided inside the loop formed by the endless belt 13 at positions confronting corresponding photosensitive drums 8, with the top surface 13A interposed therebetween. The transfer bodies 14 are rollers that rotate about rotational axes parallel to the rotational axes of the photosensitive drums 8. Applying transfer voltages to the transfer bodies 14 causes the developer images carried on the corresponding photosensitive drums 8 to be transferred onto a sheet carried on the top surface 13A.

The sheet carried on the top surface 13A moves together with the top surface 13A from the one side to the other side in the juxtaposed direction. While the sheet resting on the top surface 13A is moved in the juxtaposed direction, the developer images carried on the four photosensitive drums 8 are sequentially transferred and superimposed on the sheet.

The fixing unit 11 is adapted to fix the developer images transferred onto the sheet by applying heat and pressure to the developer. After an image has been formed on a sheet in this way, discharge rollers 3A and the like discharge the sheet onto a discharge tray 3B provided on the top of the casing 3.

A cover 3C is provided on a front wall of the casing 3. A multipurpose sheet-feeding tray (not illustrated) is provided at the cover 3C. The multipurpose sheet-feeding tray is adapted to hold a plurality of sheets.

A paper tray 17 is disposed at a bottom section of the casing 3. The paper tray 17 is capable of holding a plurality of sheets stacked therein. The paper tray 17 can be removed from the apparatus body of the image forming apparatus 1 by pulling the paper tray 17 out of the apparatus body toward the one side (front side in the embodiment) in the juxtaposed direction.

Figure 2:
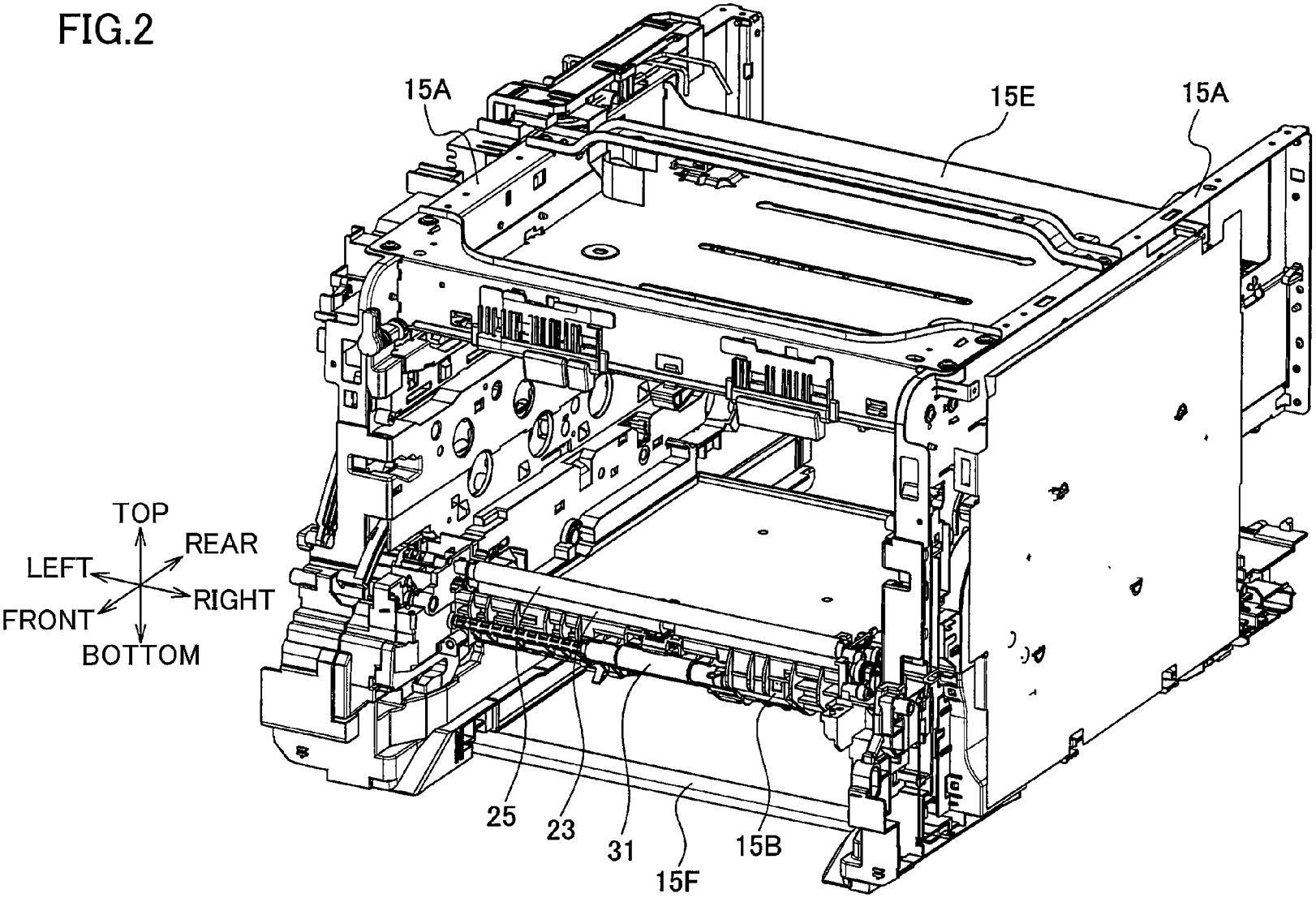
FIG. 2 is a perspective view illustrating frames of the image forming apparatus including a pair of main frames and a sheet-feeding frame.

Further, as illustrated in FIG. 2, the image forming apparatus 1 includes the pair of main frames 15A, a sheet-feeding frame 15B, a top frame 15E, and a pair of front and rear frames 15F.

The main frames 15A are substantially plate-shaped reinforcing members that are disposed one on either side of the image forming unit 5 in a horizontal direction (left-right direction in the embodiment).

The sheet-feeding frame 15B as an example of a frame has a beam-like structure that spans between the pair of main frames 15A. The sheet-feeding frame 15B is elongated in the horizontal direction. Longitudinal ends (left and right ends in the embodiment) of the sheet-feeding frame 15B are fixed to the respective main frames 15A.

The top frame 15E is disposed above the sheet-feeding frame 15B. The bottom frames 15F are disposed below the sheet-feeding frame 15B. The top frame 15E connects top edges of the main frames 15A, while the bottom frames 15F connect the bottom edges of the main frames 15A.

2. Sheet Feeding Device

The sheet feeding device provided in the image forming apparatus 1 includes the sheet-feeding frame 15B, a first feeding mechanism 19, a second feeding mechanism 21, a first roller 23, a second roller 25, a first pressing member 27A, a plurality of (two in the embodiment) second pressing members 27B, a paper-dust-removing unit 29, a third roller 31, a fourth roller 33, and a detecting unit 37.

The first feeding mechanism 19 and the second feeding mechanism 21 are provided upstream of the endless belt 13 in a sheet conveying direction.

Figure 3:
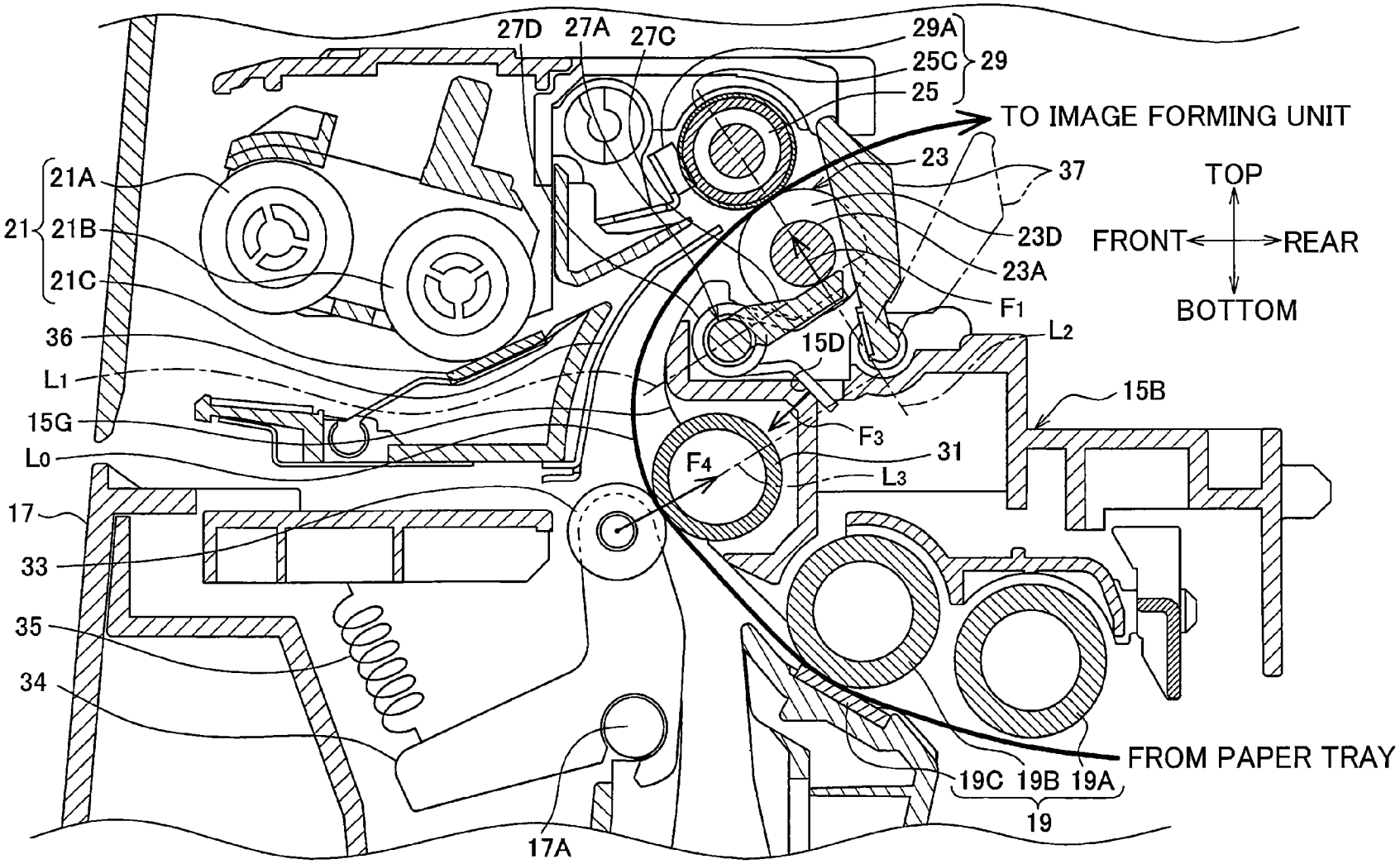
FIG. 3 is a cross-sectional view of the sheet conveying device according to the embodiment.

The first feeding mechanism 19 conveys sheets one at a time from the paper tray 17 toward the image forming unit 5. As illustrated in FIG. 3, the first feeding mechanism 19 is provided at the sheet-feeding frame 15B. The first feeding mechanism 19 includes a pickup roller 19A, a separating roller 19B, and a separating pad 19C.

The pickup roller 19A contacts the topmost sheet stacked in the paper tray 17 and feeds this sheet toward the separating roller 19B.

The separating roller 19B rotates in contact with the sheet supplied by the pickup roller 19A, applying a conveying force to the sheet.

The separating pad 19C is positioned in confrontation with the separating roller 19B and applies a conveying resistance to the sheet. Consequently, if a plurality of sheets is fed by the pickup roller 19A simultaneously, the separating roller 19B and the separating pad 19C separate the plurality of sheets so that they are conveyed to the image forming unit 5 one at a time.

As illustrated in FIG. 1, the paper tray 17 is disposed in the casing 3 at a position below the image forming unit 5. Consequently, a sheet-conveying path leading from the paper tray 17 to the image forming unit 5 has a curved section Lo formed in an approximate U-shape.

After the first feeding mechanism 19 feeds the sheet toward the one side (front side in the embodiment) in the juxtaposed direction, the sheet is conveyed along the sheet-conveying path to the image forming unit 5. In the image forming unit 5, the sheet travels from the one side (front side in the embodiment) to the other side (rear side in the embodiment) in the juxtaposed direction.

As illustrated in FIG. 3, the first feeding mechanism 19 and a portion of the sheet-feeding frame 15B are arranged on an inner circumferential side of the curved section Lo. Here, the inner circumferential side of the curved section Lo implies the side of the curved section Lo on which its center of curvature lies and, hence, the rear side of the curved section Lo in FIG. 3.

The sheet-feeding frame 15B includes an inner guide 15G forming the inner circumferential side of the curved section Lo. An outer guide 36 is provided so as to be supported by the main frames 15A to form an outer circumferential side of the curved section Lo. The inner guide 15G and the outer guide 36 serve to guide sheets conveyed along the curved section Lo.

The second feeding mechanism 21 conveys sheets stacked in the multipurpose sheet-feeding tray (not illustrated) toward the image forming unit 5 one at a time. The second feeding mechanism 21 includes a pickup roller 21A, a separating roller 21B, and a separating pad 21C.

The first roller 23 and the second roller 25 are supported in the sheet-feeding frame 15B at both axial ends (left and right ends in the embodiment) thereof. More specifically, the first roller 23 and the second roller 25 are disposed on an exit side of the curved section Lo, i.e., at a position along the sheet-conveying path on an upstream side of the image forming unit 5 in the sheet-conveying direction. The first roller 23 and the second roller 25 rotate while contacting the sheet. The second roller 25 is disposed at a position confronting the first roller 23 and rotates while pinching the sheet being conveyed together with the first roller 23. Incidentally, the first roller 23 and the second roller 25 are arranged such that their rotational axes extend in the left-right direction.

A drive force is applied to each of the first roller 23 and the second roller 25. Through this drive force, the first roller 23 and the second roller 25 are rotated and halted in association with each other. The first roller 23 and the second roller 25 perform a registration function in which the rotations of the first roller 23 and the second roller 25 are temporarily halted when a sheet is conveyed thereto, and in which the rotations of the first roller 23 and the second roller 25 are subsequently resumed to convey the sheet. Therefore, the first roller 23 is also referred to as a registration roller, while the second roller 25 is also referred to as a registration pinch roller.

More specifically, a sheet conveyed by the first feeding mechanism 19 and the second feeding mechanism 21 contacts the first roller 23 and the second roller 25 while the first roller 23 and the second roller 25 are in a halted state, temporarily halting conveyance of the sheet. Subsequently, the first roller 23 and the second roller 25 resume rotating, thereby resuming conveyance of the sheet. In this way, the first roller 23 and the second roller 25 can correct skew in the sheet so that a leading edge of the sheet is orthogonal to the sheet-conveying direction, and can subsequently introduce the sheet into the image forming unit 5 at a predetermined timing.

Figure 5:
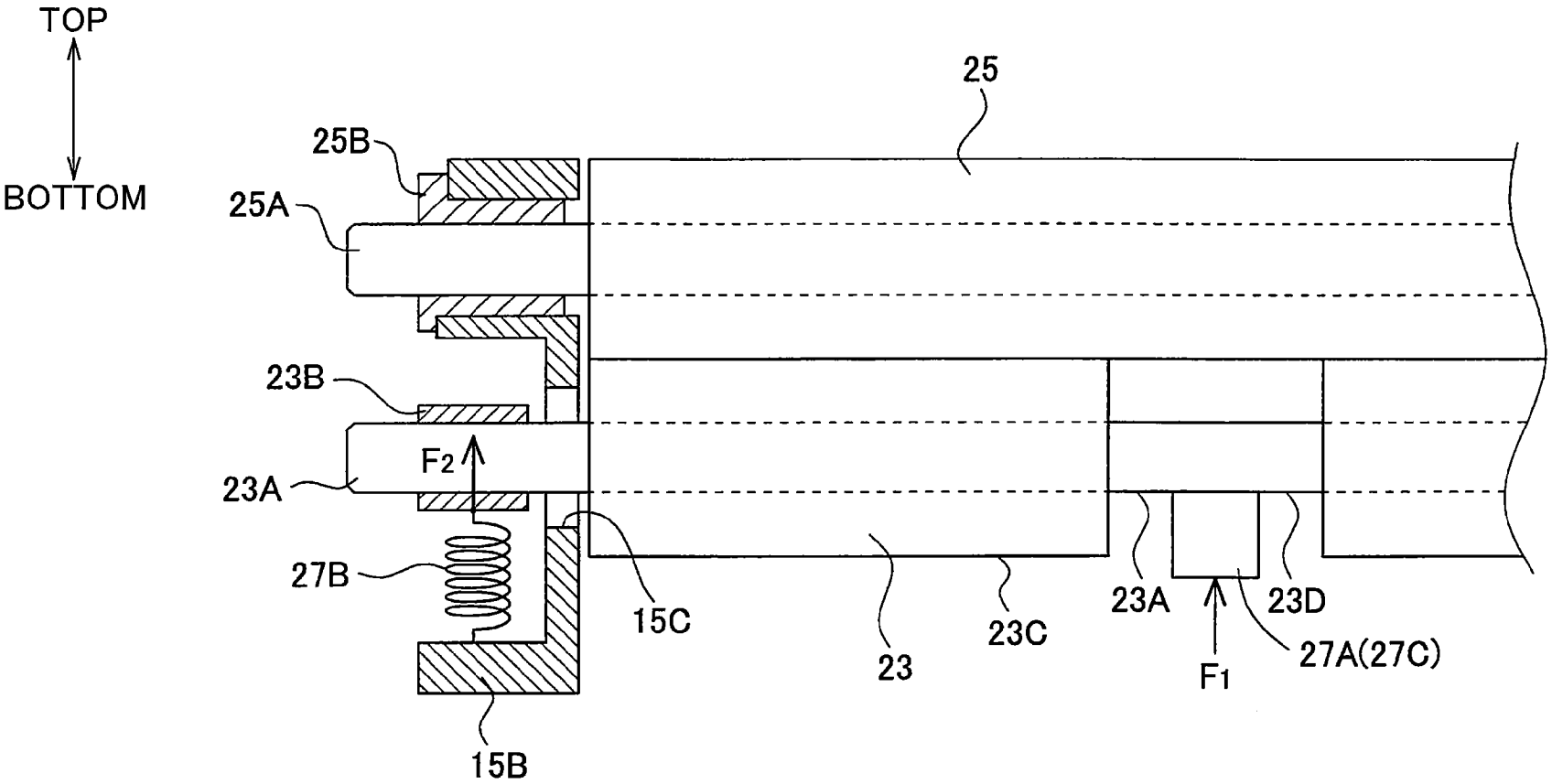
FIG. 5 is a schematic view illustrating structures for supporting a first roller and a second roller.

As illustrated in FIGS. 3 and 5, the first pressing member 27A (described later in detail) and the two second pressing members 27B (described later in detail, only one of the second pressing members 27B is illustrated in FIG. 5) are provided at the sheet-feeding frame 15B. The first pressing member 27A is provided for pressing an axial center region (left-right center region in the embodiment) of the first roller 23 toward the second roller 25. The second pressing members 27B are provided for pressing axial ends (left and right ends in the embodiment) of the first roller 23 toward the second roller 25.

Hereinafter, a force with which the first pressing member 27A presses the first roller 23 toward the second roller 25 will be referred to as a first pressing force F1, while a force with which the second pressing members 27B press the first roller 23 toward the second roller 25 will be referred to as a second pressing force F2. The first pressing member 27A and the second pressing members 27B are configured such that the first pressing force F1 is greater than the second pressing force F2.

In the embodiment, the statement that "the first pressing force F1 is greater than the second pressing force F2" indicates that the first pressing force F1 is greater than the force applied by at least one of the second pressing members 27B disposed on the axial ends of the first roller 23.

Incidentally, in the embodiment, the first pressing force F1 is set to 1 kgf, and the second pressing force F2 for each of the second pressing members 27B is set to 200 gf. In other words, the first pressing member 27A and the second pressing members 27B in the embodiment are configured such that the first pressing force F1 applied by the first pressing member 27A is greater than the sum of the second pressing forces F2 applied by both the second pressing members 27B.

Figure 4:
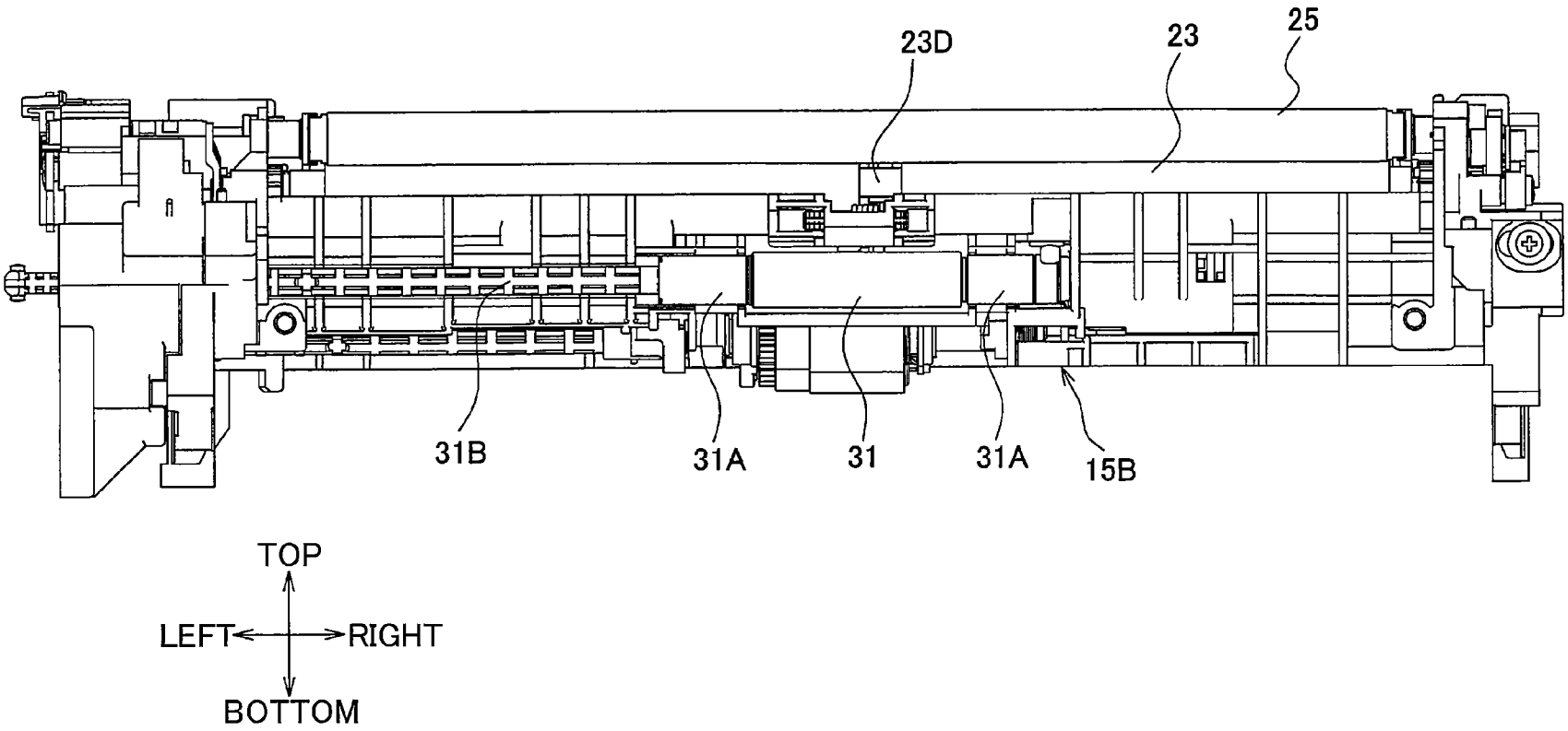
FIG. 4 is a front view of the sheet conveying device according to the embodiment.

As illustrated in FIG. 4, the second roller 25 is supported in the sheet-feeding frame 15B at both axial ends (left and right ends in the embodiment) such that its rotational axis cannot be displaced relative to the sheet-feeding frame 15B.

More specifically, as illustrated in FIG. 5, the second roller 25 has a second roller shaft 25A. Axial ends of the second roller shaft 25A are rotatably supported in second roller bearings 25B (only one of the second roller bearings 25B is illustrated in FIG. 5). The second roller bearings 25B are fixed to the sheet-feeding frame 15B. Thus, the second roller 25 is rotatably supported in the sheet-feeding frame 15B through the second roller bearings 25B. In other words, the second roller 25 is supported in the sheet-feeding frame 15B at both axial ends such that the second roller 25 is capable of rotating about its rotational axis, but cannot be displaced relative to the sheet-feeding frame 15B.

The first roller 23 is assembled in the sheet-feeding frame 15B so as to be displaceable relative to the second roller 25 in directions toward and away from the second roller 25 (hereinafter also referred to as contacting/separating directions). The contacting/separating directions are orthogonal to rotational axes of the first roller 23 and the second roller 25.

More specifically, as illustrated in FIG. 5, the first roller 23 has a first roller shaft 23A, and a covering part 23C. Axial ends of the first roller shaft 23A extend through elongate holes 15C formed in the sheet-feeding frame 15B and are rotatably supported in first roller bearings 23B (only one of the first roller bearings 23B is illustrated in FIG. 5). The elongate hole 15C has a major diameter aligned in the contacting/separating directions and, that is, in a direction orthogonal to the rotational axis of the second roller 25. Thus, the first roller 23 is rotatably supported in the sheet-feeding frame 15B through the first roller bearings 23B.

The first roller bearings 23B are provided at the sheet-feeding frame 15B so as to be movable in the contacting/separating directions. The resilient force of the second pressing members 27B presses the corresponding first roller bearings 23B toward the second roller 25 (i.e. in the contacting direction). With this configuration, the first roller 23 is rotatably supported in the sheet-feeding frame 15B such that the first roller 23 is capable of rotating about its rotational axis and capable of being displaced relative to the rotational axis of the second roller 25 in the contacting/separating directions.

The covering part 23C covers the first roller shaft 23A. The covering part 23C is formed of rubber or another material having a large coefficient of friction. The covering part 23C is not provided over the axial center region of the first roller 23, leaving the first roller shaft 23A exposed in this region. This portion of the first roller shaft 23A will be referred to as an exposed part 23D. The first roller shaft 23A is formed of metal. An outer circumferential surface of the first roller shaft 23A, at least at the exposed part 23D, is subjected to a surface treatment, such as chrome plating, to give the surface good wear resistance and a low coefficient of friction. The first roller 23 receives the first pressing force F1 from the first pressing member 27A at the exposed part 23D.

As illustrated in FIG. 3, the first pressing member 27A includes a contacting part 27C, and a spring 27D.

The contacting part 27C pressingly contacts the outer circumferential surface of the first roller shaft 23A at the exposed part 23D. When the first roller 23 rotates, the outer circumferential surface of the first roller shaft 23A at the exposed part 23D is in sliding contact with the contacting part 27C.

The spring 27D exerts the first pressing force F1 that is applied to the first roller shaft 23A through the contacting part 27C.

Since the spring 27D exerts the first pressing force F1 at one end (upper end in the embodiment) thereof, a reaction force F3 is generated at another end (lower end in the embodiment) of the spring 27D as a reaction to the first pressing force F1. This reaction force F3 is received by the sheet-feeding frame 15B at a pressure-receiving part 15D constituting an approximate longitudinal center region (left-right center region in the embodiment) of the sheet-feeding frame 15B.

The spring 27D is a torsion coil spring. The spring 27D is assembled to the sheet-feeding frame 15B with an axis of its coil portion oriented parallel to the rotational axis of the first roller 23. Note that the rotational axes of the first roller 23 and the second roller 25 are aligned with a longitudinal dimension of the sheet-feeding frame 15B.

The contacting part 27C is a pressing arm that can pivotally move toward and away from the first roller shaft 23A about the coil axis of the spring 27D. When the contacting part 27C is in contact with the first roller shaft 23A, an imaginary line L1 passing through the point of contact between the contacting part 27C and the first roller shaft 23A and the pivoting axis of the contacting part 27C is approximately orthogonal to an imaginary line L2 passing through the rotational axes of the first roller 23 and the second roller 25.

Note that the imaginary line L2 will also be referred to as a normal L2 at a nipping portion where a sheet is nipped between the first roller 23 and the second roller 25.

The second pressing members 27B are configured of coil springs. One end of the coil spring constituting each of the second pressing members 27B is attached to the first roller bearing 23B, and another end thereof is attached to the sheet-feeding frame 15B.

The paper-dust-removing unit 29 is disposed on an entrance side of the image forming unit 5. The paper-dust-removing unit 29 removes paper dust deposited on the sheets. The paper-dust-removing unit 29 includes the second roller 25, and a charging part 29A.

The charging part 29A contacts an outer circumferential surface of the second roller 25 such that the outer circumferential surface of the second roller 25 slides over the charging part 29A (hereinafter referred to as "slidingly contacts") when the second roller 25 rotates. A contact-receiving part 25C formed of fluororesin is provided around the circumferential surface of the second roller 25. When the second roller 25 rotates, the contact-receiving part 25C slidingly contacts the charging part 29A. As a result, the contact-receiving part 25C is tribocharged.

With this configuration, paper dust deposits on the sheets are captured on the charged surface of the second roller 25 by electrostatic attraction. Thus, the second roller 25 also serves as a paper-dust-removing roller. The paper dust attracted to the second roller 25 is subsequently scraped off the second roller 25 by the charging part 29A.

The third roller 31 and the fourth roller 33 are disposed on an entrance side of the curved section Lo, i.e., at a position along the sheet-conveying path on an upstream side of the first roller 23 and the second roller 25 in the sheet-conveying direction. The third roller 31 and the fourth roller 33 rotate while contacting the sheet. Incidentally, the third roller 31 and the fourth roller 33 are arranged such that their rotational axes extend in the left-right direction.

The third roller 31 is rotatably supported in the sheet-feeding frame 15B. More specifically, the third roller 31 is assembled in the sheet-feeding frame 15B such that its rotational axis cannot be displaced relative to the sheet-feeding frame 15B. The fourth roller 33 as an example of a conveying member rotates while nipping the sheet together with the third roller 31.

Note that the first roller 23 and the third roller 31 contact one surface of the sheet, while the second roller 25 and the fourth roller 33 contact another surface of the sheet. The surface contacted by the first roller 23 and the third roller 31 faces the inner guide 15G on the inner circumferential side of the curved section Lo. The surface contacted by the second roller 25 and the fourth roller 33 faces the outer guide 36 on the outer circumferential side of the curved section Lo.

Figure 6:
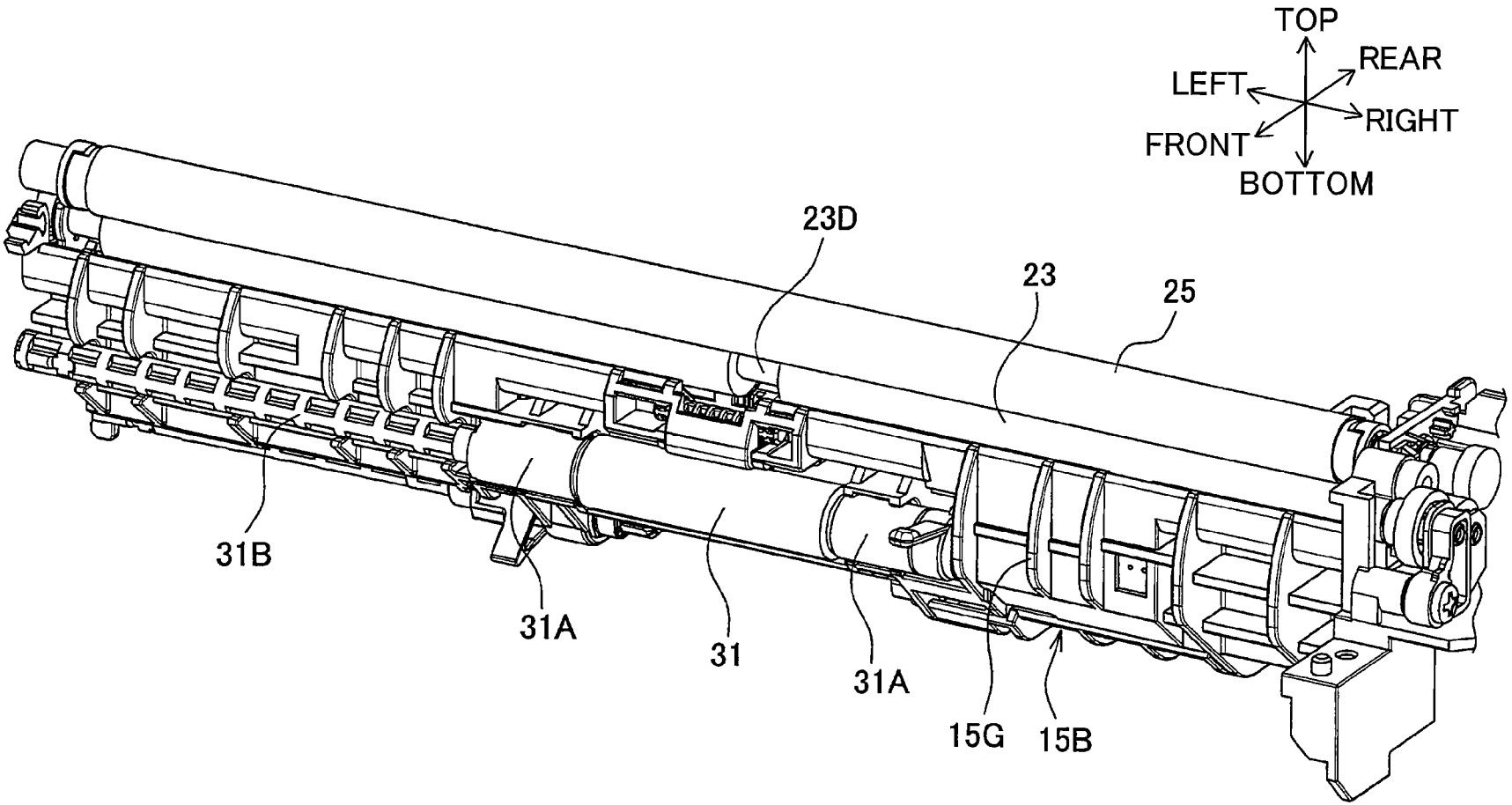
FIG. 6 is a perspective view of the sheet conveying device according to the embodiment.

As illustrated in FIG. 6, third roller bearings 31A are fixed to the sheet-feeding frame 15B for rotatably supporting axial ends of the third roller 31. Thus, the third roller 31 is rotatably supported in the sheet-feeding frame 15B through the third roller bearings 31A. In other words, the third roller 31 is supported in the sheet-feeding frame 15B at both axial ends such that the third roller 31 is capable of rotating about its rotational axis, but cannot be displaced relative to the sheet-feeding frame 15B. A drive shaft 31B coupled to one end (left end in the embodiment) of the third roller 31 applies a drive force to the third roller 31.

The third roller bearings 31A are disposed at positions offset from longitudinal ends (left and right ends in the embodiment) of the sheet-feeding frame 15B toward the longitudinal center region of the sheet-feeding frame 15B. Thus, the third roller 31 is disposed such that its axial center is disposed at the approximate longitudinal center region of the sheet-feeding frame 15B.

With this configuration, the third roller bearings 31A can be positioned in regions offset from the longitudinal ends of the sheet-feeding frame 15B toward the longitudinal center region of the sheet-feeding frame 15B. The third roller 31 contacts the sheet at a position in the approximate longitudinal center region of the sheet-feeding frame 15B.

The axial center of the third roller 31 is positioned to correspond approximately to the exposed part 23D, i.e., the region of the first roller shaft 23A of the first roller 23 at which the first pressing member 27A applies the first pressing force F1. The pressure-receiving part 15D of the sheet-feeding frame 15B is positioned on a side opposite to the fourth roller 33 with respect to the third roller 31 (see also FIG. 3).

As illustrated in FIG. 3, the fourth roller 33 is disposed at a position confronting the third roller 31 and rotates together with the third roller 31 to convey the sheet nipped therebetween. The fourth roller 33 rotates to follow the movement of a sheet conveyed in the sheet-conveying path.

The fourth roller 33 is rotatably supported in the paper tray 17. More specifically, the fourth roller 33 is disposed at the paper tray 17 such that its rotational axis can be displaced relative to the rotational axis of the third roller 31. More specifically, the fourth roller 33 is rotatably supported by a support member 34. The support member 34 is pivotably assembled to a pivot shaft 17A provided at the paper tray 17. The fourth roller 33 is separated from the third roller 31 when the paper tray 17 is pulled out of the apparatus body toward the one side (front side in the embodiment) in the juxtaposed direction.

A spring 35 is provided in the sheet feeding device such that one end of the spring 35 is attached to an end of the support member 34 opposite an end on which the fourth roller 33 is supported, and another end of the spring 35 is attached to the paper tray 17. The spring 35 exerts a resilient force on the support member 34 for eventually displacing the fourth roller 33 toward the third roller 31. This configuration generates a nipping force for nipping a sheet at a contacting portion between the third roller 31 and the fourth roller 33 (hereinafter also referred to as a nipping portion).

Hence, the spring 35 serves as a force-generating unit for generating the nipping force. Since the spring 35 applies the resilient force to the support member 34 to pivotally move the fourth roller 33 toward the third roller 31 and thus urges the fourth roller 33 toward the third roller 31, the resilient force generates an urging force F4 to be applied to the sheet-feeding frame 15B in a direction away from the fourth roller 33.

The spring 35 is a tension spring. One end of the spring 35 is connected to the support member 34, and another end thereof is connected to the paper tray 17.

The urging force F4 is applied to the longitudinal center region of the sheet-feeding frame 15B and acts to deform the sheet-feeding frame 15B in a direction away from the fourth roller 33. The reaction force F3, on the other hand, is applied to the pressure-receiving part 15D in the longitudinal center region of the sheet-feeding frame 15B and acts in a direction for pressing the sheet-feeding frame 15B toward the fourth roller 33.

A portion of the sheet-feeding frame 15B that supports the first roller 23 and the third roller 31 is disposed on the inner circumferential side of the curved section Lo and has the inner guide 15G forming the inner circumferential side of the curved section Lo. Further, the third roller 31 and the fourth roller 33 are disposed on the entrance side of the curved section Lo, and the first roller 23 and the second roller 25 are disposed on the exit side of the curved section Lo. The outer guide 36 is also disposed on the outer circumferential side of the curved section Lo between the entrance side of the curved section Lo and the exit side of the curved section Lo.

Accordingly, the normal L2 (as an example of a first line) at the nipping portion between the first roller 23 and the second roller 25 intersects a normal L3 (as an example of a second line) at the nipping portion between the third roller 31 and the fourth roller 33 on an inside of the sheet-feeding frame 15B. The normal L3 also passes through the rotational axes of the third roller 31 and the fourth roller 33. In other words, the normal L3 is defined by connecting the rotational axis of the third roller 31 to the nipping portion where the sheet is nipped between the third roller 31 and the fourth roller 33. The spring 27D is positioned on the curved section Lo side of the intersection point between the normal L2 and the normal L3. In other words, as viewed in an axial direction (left-right direction in the embodiment) of the first roller 23, the spring 27D is positioned between the curved section Lo and the intersection point.

The detecting unit 37 is provided at the sheet-feeding frame 15B and constitutes an actuator of a sensor. The detecting unit 37 is displaced when contacted by a sheet, enabling the sensor to detect the presence of the sheet passing through the registration rollers (i.e., the first roller 23 and the second roller 25).

The detecting unit 37 can be displaced between a remote position and a proximal position. In the remote position indicated by a double chain line in FIG. 3, the detecting unit 37 is separated from the exposed part 23D. In the proximal position indicated by a solid line in FIG. 3, the detecting unit 37 is adjacent to the exposed part 23D. A control unit (not illustrated) provided in the image forming apparatus 1 controls image-forming operations, such as the timing of developer image transfers, based on the timing that the detecting unit 37 detects the leading edge of the sheet with respect to the sheet-conveying direction. In the proximal position, the detecting unit 37 is configured to overlap the covering part 23C as viewed in the axial direction of the first roller 23.

3. Features of Image Forming Apparatus According to Above-Described Embodiment As illustrated in FIG. 3, one feature according to the above-described embodiment is that when the first pressing member 27A presses the axial center region of the first roller 23 toward the second roller 25, the reaction force F3 is applied to the sheet-feeding frame 15B, pressing the sheet-feeding frame 15B toward the fourth roller 33.

In this way, the reaction force F3 presses the sheet-feeding frame 15B toward the fourth roller 33, while the nipping force generated between the third roller 31 and the fourth roller 33 presses the sheet-feeding frame 15B away from the fourth roller 33. Therefore, the reaction force F3 and the nipping force are offset and cancel each other out, thereby restraining deformation of the sheet-feeding frame 15B.

By suppressing deformation of the sheet-feeding frame 15B while increasing the nipping force between the first roller 23 and the second roller 25 at the axial center region of the first roller 23 owing to the pressure applied by the first pressing member 27A, the structure according to the above-described embodiment suppresses a decrease in the nipping force at the axial center region of the first roller 23.

Here, the statement that the reaction force and the nipping force "are offset and cancel each other out" naturally includes a case in which the net force of the reaction force and the nipping force is zero, but also includes a case in which the magnitude of this net force is smaller than the magnitude of the reaction force or the magnitude of the nipping force.

When the sheet-feeding frame 15B is formed of resin, stress applied to the sheet-feeding frame 15B may cause the sheet-feeding frame 15B to deform through creep, even when a bending moment acting on the sheet-feeding frame 15B is relatively small.

However, the above-described embodiment can suppress deformation by creep in the sheet-feeding frame 15B since the reaction force and the nipping force are offset and cancel each other out. Accordingly, the structure according to the above-described embodiment suppresses a decline in the nipping force at the axial center region of the first roller 23 over a long period of time, even when the sheet-feeding frame 15B is formed of resin.

As another feature according to the above-described embodiment, the second pressing members 27B are provided to exert the second pressing force F2 for pressing the axial ends of the first roller 23 toward the second roller 25. Accordingly, the first roller 23 is pressed toward the second roller 25 in at least three locations, including the axial ends and the axial center region of the first roller 23.

Therefore, this configuration can press the first roller 23 toward the second roller 25 while maintaining the first roller 23 parallel to the second roller 25 with a high degree of precision. Consequently, the first roller 23 and the second roller 25 apply a prescribed nipping force or greater at all points across the width of the sheet being conveyed, thereby conveying the sheet with stability.

Rollers and other long members deform primarily in their longitudinal center regions. Therefore, providing the first pressing force F1 greater than the second pressing force F2 in the above-described embodiment effectively suppresses a drop in the nipping force in the longitudinal center region.

In the above-described embodiment, the sheet-feeding frame 15B receives the nipping force through the third roller 31. The third roller bearings 31A is fixed to the sheet-feeding frame 15B for rotatably supporting the third roller 31 such that the third roller 31 cannot be displaced relative to the sheet-feeding frame 15B.

Another feature according to the above-described embodiment is that the fourth roller 33 can be displaced relative to the third roller 31. Further, the spring 35 serving as a force-generating unit presses the fourth roller 33 against the third roller 31 to generate the nipping force.

Since the spring 35 urges the fourth roller 33 against the third roller 31 supported in the sheet-feeding frame 15B so as not to be capable of displacing relative to the sheet-feeding frame 15B, the reaction force F3 and the nipping force can be effectively offset and cancelled out.

By arranging the third roller bearings 31A closer to the longitudinal center region of the sheet-feeding frame 15B than the longitudinal ends of the sheet-feeding frame 15B as described in the embodiment, the nipping force applied through the third roller bearings 31A is concentrated in the longitudinal center region of the sheet-feeding frame 15B. Thus, this structure may invite deformation in the longitudinal center region of the sheet-feeding frame 15B.

However, since the reaction force F3 in the above-described embodiment effectively cancels the nipping force, the structure according to the above-described embodiment suppresses deformation in the sheet-feeding frame 15B, even though the third roller bearings 31A are offset from the longitudinal ends of the sheet-feeding frame 15B toward the longitudinal center region of the sheet-feeding frame 15B.

In the above-described embodiment, a portion of the sheet-feeding frame 15B that supports the first roller 23 and the third roller 31 is disposed on the inner circumferential side of the curved section Lo. With this configuration, the first pressing member 27A can be positioned between the first roller 23 and the sheet-feeding frame 15B.

In the above-described embodiment, the normal L2 connecting the rotational axis of the first roller 23 to the rotational axis of the second roller 25 intersects the normal L3 connecting the rotational axis of the third roller 31 to the nipping portion where the sheet is nipped between the third roller 31 and the fourth roller 33, and the intersecting point between the normal L2 and the normal L3 is positioned inside the sheet-feeding frame 15B on the inner circumferential side of the curved section Lo. With this configuration, the first pressing member 27A can be positioned close to the intersection point between the normal L2 and the normal L3.

In the above-described embodiment, the first roller 23 has the first roller shaft 23A, and the rubber covering part 23C covering the first roller shaft 23A. Another feature according to the above-described embodiment is that the exposed part 23D is provided at the axial center region of the first roller 23 and constitutes the region of the first roller shaft 23A not covered by the covering part 23C. The exposed part 23D receives the first pressing force F1.

With this construction, the first pressing force F1 is applied to the portion of the first roller shaft 23A corresponding to the exposed part 23D, which is not covered by the covering part 23C. Therefore, the structure according to the above-described embodiment restrains occurrence of problems such as premature damage to the rubber covering part 23C.

Another feature according to the above-described embodiment is that the first pressing member 27A has the contacting part 27C with which the outer circumferential surface of the metal first roller shaft 23A at the exposed part 23D is in sliding contact when the first roller 23 rotates. This configuration according to the above-described embodiment suppresses occurrence of problems such as deformation or premature wear of the first roller 23 by the first pressing force F1.

As described above, the structure according to the above-described embodiment suppresses a drop in the nipping force (pressure at the contact surfaces) in the axial center region of the first roller 23 and the second roller 25. Therefore, when the second roller 25 also functions as a paper dust removing roller as described in the embodiment, the second roller 25 can apply at least a prescribed nipping force across its entire widthwise dimension. Accordingly, the second roller 25 can effectively remove paper dust.

Another feature according to the above-described embodiment is that the first roller 23 and the second roller 25 have a registration function for temporarily halting conveyance of the sheet supplied thereto, then subsequently resuming conveyance of the sheet.

In this way, the sheet is thrust into the position between the first roller 23 and the second roller 25 when the first roller 23 and the second roller 25 are in a halted state. Since the first roller 23 and the second roller 25 produce a prescribed nipping force or greater across their entire widthwise dimensions, the first roller 23 and the second roller 25 can reliably halt the leading edge of the sheet to temporarily halt the sheet and can thereby reliably implement their registration function.

The structure according to the above-described embodiment is particularly effective when a sheet having a small widthwise dimension is conveyed through the axial center region of the first roller 23 and the second roller 25. Since the structure according to the above-described embodiment prevents a drop in the nipping force (pressure at the contact surfaces) in the axial center region of the first roller 23 and the second roller 25, the first roller 23 and the second roller 25 can reliably implement the registration function.

Another feature according to the above-described embodiment is that the first pressing member 27A is a torsion coil spring. One end of the first pressing member 27A exerts the first pressing force F1, while the other end presses against the pressure-receiving part 15D in the approximate longitudinal center region of the sheet-feeding frame 15B.

Accordingly, the structure according to the above-described embodiment can exert a large first pressing force F1 within a small mounting space and can eliminate the need for considering distortion by buckling, which is common with coil springs, thereby improving design freedom.

4. Modifications

Various modifications are conceivable. In the following description, only parts differing from those of the above-described embodiment will be described in detail.

In the above-described embodiment, in addition to the first pressing force F1 applied to the axial center region of the first roller 23, the second pressing force F2 is applied to both axial ends of the first roller 23. However, the present invention is not limited to this construction, provided that at least the first pressing force F1 is applied.

In the above-described embodiment, the first pressing force F1 is set to a value greater than the second pressing force F2, but the first pressing force F1 may be set to a value equivalent to the second pressing force F2 or a value smaller than the second pressing force F2.

In the above-described embodiment, the contacting part 27C contacts the first roller shaft 23A in the exposed part 23D to apply the first pressing force F1 to the first roller 23. However, the exposed part 23D may be eliminated and the first pressing force F1 may be applied to the covering part 23C through a roller or the like.

In the above-described embodiment, the detecting unit 37 is disposed in a region corresponding to the exposed part 23D, but the detecting unit 37 may be disposed in another position.

The second roller 25 in the above-described embodiment also functions as a paper dust removing roller, but a separate roller may be provided for this function.

The first roller 23 and the second roller 25 in the above-described embodiment implement a registration function, but these rollers may be simple conveying rollers having no registration function.

The first pressing member 27A is configured of a torsion coil spring in the above-described embodiment, but the first pressing member 27A may be configured of a different member, such as a coil spring or a leaf spring.

In the above-described embodiment, a portion of the sheet-feeding frame 15B that retains the first roller 23 and the third roller 31 is disposed on the inner circumferential side of the curved section Lo, but the sheet-feeding frame 15B may be disposed in a region along the sheet-conveying path that is not curved, for example.

The sheet-feeding frame 15B in the above-described embodiment is formed of a resin material, but the sheet-feeding frame 15B may be formed of a metal material, for example. Alternatively, the sheet-feeding frame 15B may be formed of a resin material having an embedded metal reinforcing member.

While the fourth roller 33 as an example of a conveying member confronts the third roller 31 in the above-described embodiment, the conveying member confronting the third roller 31 may be implemented by a separating pad.

While the present invention has been described in detail with reference to the embodiment thereof, it would be apparent to those skilled in the art that various changes and modifications may be made therein without departing from the spirit of the present invention.

What is claimed is:

1. A sheet conveying device configured to convey a sheet along a sheet-conveying path, the sheet conveying device comprising:

a first roller configured to rotate while contacting the sheet, the first roller rotating about a rotational axis extending in an axial direction and having an axial center region in the axial direction;

a second roller disposed in confrontation with the first roller, the second roller being configured to rotate while nipping the sheet in cooperation with the first roller;

a third roller disposed spaced apart from the first roller, the third roller rotating about a rotational axis extending in the axial direction and being configured to rotate while contacting the sheet;

a conveying member disposed in confrontation with the third roller, the conveying member being configured to nip the sheet in cooperation with the third roller;

a frame elongated in the axial direction and supporting the third roller;

a first pressing member configured to apply a first pressing force to the axial center region of the first roller to press the first roller toward the second roller, the first pressing member being further configured to apply, to the frame, a reaction force generated as a reaction to the first pressing force to press the frame in a direction toward the conveying member; and a force-generating unit configured to generate a nipping force for nipping the sheet between the third roller and the conveying member, the force-generating unit being further configured to apply an urging force to the frame in a direction away from the conveying member.

2. The sheet conveying device as claimed in claim 1, wherein the first roller has axial end portions in the axial direction, the sheet conveying device further comprising: a second pressing member configured to apply a second pressing force to the axial end portions of the first roller to press the first roller toward the second roller.

3. The sheet conveying device as claimed in claim 2, wherein the first pressing force is greater than the second pressing force.

4. The sheet conveying device as claimed in claim 1, wherein the frame includes a bearing portion for rotatably supporting the third roller such that displacement of the rotational axis of the third roller is prohibited relative to the frame, wherein the conveying member is configured to be displaced relative to the rotational axis of the third roller; and wherein the force-generating unit is configured to urge the conveying member toward the third roller to generate the nipping force.

5. The sheet conveying device as claimed in claim 4, wherein the frame has a longitudinal center region and a longitudinal end portion in the axial direction, wherein the bearing portion is disposed offset from the longitudinal end portion of the frame toward the longitudinal center region of the frame.

6. The sheet conveying device as claimed in claim 1, wherein the sheet-conveying path has a curved section at a position between the first roller and the third roller, the curved section defining an inner circumferential side at which the first roller and the third roller are positioned, wherein the frame has a portion that supports the third roller, the portion being disposed on the inner circumferential side.

7. The sheet conveying device as claimed in claim 6, wherein the first roller and the second roller defines a first line connecting the rotational axis of the first roller to a rotational axis of the second roller, and the third roller and the conveying member defines a second line connecting the rotational axis of the third roller to a nipping portion where the sheet is nipped between the third roller and the conveying member, wherein the first line intersects the second line inside the frame on the inner circumferential side.

8. The sheet conveying device as claimed in claim 1, wherein the first roller includes a first roller shaft and a covering part configured to cover the first roller shaft, the covering part being formed of rubber, wherein the first roller has an axial center region in the axial direction where the first roller shaft is exposed to provide an exposed part, the first roller being configured to receive the first pressing force from the first pressing member at the exposed part.

9. The sheet conveying device as claimed in claim 8, wherein the first roller shaft is formed of metal and has an outer circumferential surface, wherein the first pressing member includes a contacting part configured to be in sliding-contact with the outer circumferential surface of the first roller shaft at the exposed part.

10. The sheet conveying device as claimed in claim 8, further comprising a detecting unit configured to be displaced between a proximal position where the detecting unit is adjacent to the exposed part and a remote position where the detecting unit is separated from the exposed part to detect a presence of the sheet.

11. The sheet conveying device as claimed in claim 10, wherein the remote position is provided upon contacting of a leading edge of the sheet passing between the first roller and the second roller with the detecting unit, the sheet being detected in response to displacement of the detecting unit from the proximal position to the remote position.

12. The sheet conveying device as claimed in claim 1, wherein the second roller is a paper dust removing roller configured to remove paper dust deposited on the sheet by electrostatic attraction.

13. The sheet conveying device as claimed in claim 1, wherein the first roller and the second roller have a registration function configured to temporarily halt conveyance of the sheet conveyed to a position between the first roller and the second roller and to subsequently resume conveyance of the sheet.

14. The sheet conveying device as claimed in claim 1, wherein the first pressing member comprises a torsion coil spring having one end configured to exert the first pressing force on the first roller and another end configured to press against the frame.

15. An image forming apparatus comprising:

a sheet conveying device configured to convey a sheet along a sheet-conveying path, the sheet conveying device comprising:

a first roller configured to rotate while contacting the sheet, the first roller rotating about a rotational axis extending in an axial direction and having an axial center region in the axial direction;

a second roller disposed in confrontation with the first roller, the second roller being configured to rotate while nipping the sheet in cooperation with the first roller;

a third roller disposed spaced apart from the first roller, the third roller rotating about a rotational axis extending in the axial direction and being configured to rotate while contacting the sheet;

a conveying member disposed in confrontation with the third roller, the conveying member being configured to nip the sheet in cooperation with the third roller;

a frame elongated in the axial direction and supporting the third roller;

a first pressing member configured to apply a first pressing force to the axial center region of the first roller to press the first roller toward the second roller, the first pressing member being further configured to apply, to the frame, a reaction force generated as a reaction to the first pressing force to press the frame in a direction toward the conveying member; and a force-generating unit configured to generate a nipping force for nipping the sheet between the third roller and the conveying member, the force-generating unit being further configured to apply an urging force to the frame in a direction away from the conveying member; and an image forming unit configured to form an image on the sheet conveyed by the sheet conveying device.

* * * * *